United States Patent [19]

Peichl et al.

[11] Patent Number: 4,769,092

[45] Date of Patent: Sep. 6, 1988

[54] VARIABLE COOLING DEVICE FOR TURBO ENGINE WALL PARTS

[75] Inventors: Lothar Peichl, Dachau; Horst Pillhoefer, Karlsfeld; Heinrich Walter, Friedberg; Raimund Lackermeier, Goldach; Max Kraus, Munich, all of Fed. Rep. of Germany

[73] Assignee: MTU Motoren-und-Turbinen-Union Muenchen GmbH, Fed. Rep. of Germany

[21] Appl. No.: 14,781

[22] Filed: Feb. 13, 1987

[30] Foreign Application Priority Data

Feb. 18, 1986 [DE] Fed. Rep. of Germany ..... 3605153

[51] Int. Cl.[4] ..... C21D 1/06

[52] U.S. Cl. ..... 148/145; 165/61; 62/304

[58] Field of Search ..... 62/304; 148/145, 150, 148/152, 154; 432/171; 165/61

[56] References Cited

U.S. PATENT DOCUMENTS

| | | | |
|---|---|---|---|
| 4,017,708 | 4/1977 | Engel et al. | 148/145 |
| 4,375,997 | 3/1983 | Matz | 148/145 |
| 4,452,647 | 6/1984 | Sailas | 148/145 |
| 4,486,248 | 12/1984 | Ackert et al. | 148/145 |

*Primary Examiner*—Henry A. Bennett

*Attorney, Agent, or Firm*—Barnes & Thornburg

[57] ABSTRACT

Device for the differential cooling or temperature control of inside and outside walls or wall areas of a component, more particularly of a turbomachine component. The device has nozzle arrays or spray pipes under locally separate and/or phased control for the admission of thermally controlled medium. Use of various media and differential temperatures and pressures. Transportation of the component from treatment station to treatment station in its passage.

30 Claims, 6 Drawing Sheets

VARIABLE COOLING DEVICE FOR TURBO ENGINE WALL PARTS

This invention relates to a device described in the generic part of claim 1. It applies to general mechanical engineering, more particularly to turbomachine engineering, where components have a central bore, such as a hub bore.

Machine components of this description normally come under high stresses from mechanical forces, such as centrifugal forces, and concurrently from thermal stresses. More particularly, there result transient temperature and stress fields caused by fluid effects, more particularly of a working fluid, such as gas in a gas turbine, steam in a steam turbine, air in a compressor or exhaust gas in a turbocharger. The attendant heat transfers, as by thermal conduction, are very difficult to predict. See progress reports of VDI Zeitschriften Reihe 6 Nr. 39 entitled "Aufheiz- und Abkühlvorgänge in Platten".

The thermal stress accordingly is determined by the type of material, the dimensions of the component and the intensity of the cooling or heating process on the surface or in the interior of the plate, i.e., by the temperature gradient across the plate.

Such temperature gradients, however, are also generated deliberately to set up internal stresses, such as internal compressive stresses, as so-called preloads. Cf. the book: "Eigenspannungen, Entstehung-Messung-Bewertung", published by E. Macherauch and V. Hauk of the Deutsche Gesellschaft für Metallkunde e.V. 1983.

This book describes various investigations on alloyed steels to explore, e.g., the development of internal stresses in the surface and core areas of a steel cylinder. It is concluded that a correlation can generally be made of the hardenability profile with the internal stress profile.

In a broad aspect the present invention provides an advantageous approach to using selective treatment to set up desired internal stresses in metallic materials, especially metal alloys and including powder metallurgical materials. This will permit to suitably control the treatment parameters for components, especially solids of revolution having a bore in their central area, more particularly turbomachine components with a hub bore, and even bladed turbine disks.

It is a particular object of the present invention to provide a device described in claim 1. Further aspects of the present invention are described in subclaims. Advantages of the invention are described in light of the accompanying drawings, which illustrate an embodiment of the invention.

The most essential advantage afforded by the present invention is that internal stresses can suitably be set up in the highly stressed component by selectively controlling the intensity of the cooling process locally and/or timing it such that the desired temperature gradients relative to the bore, or with turbomachines relative to the hub, can be achieved. The cooling of the hub relative to the larger surfaces, therefore, can be precipitated. Cooling can also be controlled such that too rapid a cooling effect and the attending stress cracking are prevented. In a preferred aspect, control is infinitely variable. In a most simple version the inner cooling in the hub area is turned on before the component is cooled from the outside. Further embodiments of the invention are described below.

The invention is not restricted to certain materials, certain components (size and shape) and cooling or temperature control means. The inventive concept expressly embraces all combinations and subcombinations of the characteristics described, depicted and claimed, both with each other and with known characteristics. As already described above the invention relates not alone to cooling processes but can equally well be used also for heating, especially for slow heating by means of a medium, and for cooling. The medium can further be used to maintain a certain, preselected, i.e. controllable temperature with the aid of a medium at least in a local area and for a certain period of time.

The device of the present invention has proved its value in practical application, when clear indications were noted that after heat treatment or cooling, internal compressive stresses are present in a component. In a preferred application the bore diameter in the hub of the turbomachine component was shown to have decreased after cooling to a degree that was measurable already after relatively moderate cooling. The variation in contour noted in the hub, therefore, is a qualitative and nondestructively determinable measure of the internal compressive stresses achieved by selectively controlled treatment, such as hardening in the desired area or to the desired degree.

BRIEF DESCRIPTION OF DRAWINGS

Identical parts carry identical reference numerals in all Figures.

Figure 1:
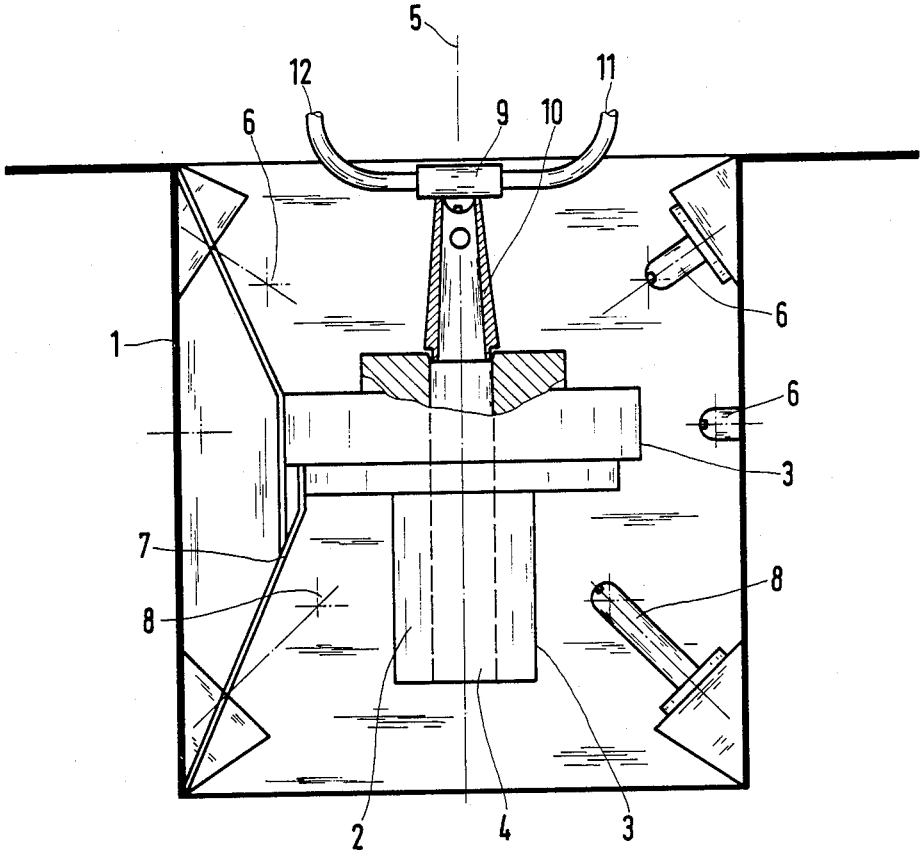
FIG. 1 Cooling device for internal and external cooling of a component located centrally in the device, FIG. 2 with located component and movable nozzle arrays or spray arms, FIG. 3 with nozzle arrays or spray arms capable of relative motion with respect to each other.

Illustrated in FIG. 1 is a device for the controlled production of differential temperatures on a component, more particularly inside and outside.

Control is phased or locally staggered, where in a most simple case a timing means is provided, especially an electronic control circuit with means, such as RC elements, permitting the inside cooling to be activated before the outside cooling is. The start and the end of any admission of cooling medium through a nozzle or a spray pipe is controlled by this timer or these timers (RC elements) in a desired, preselected manner.

The locally staggered control for inside and outside cooling, respectively, becomes readily apparent from FIG. 1, where in a vat 1 or case of the device, a component 2, such as a rotor disk of a turbomachine, with outside surfaces 3 and an inner surface 4 here represented by a hub bore, is arranged about the central axis 5. The central axis at once is the centerline of all nozzle arrays or spray arms, whether arranged movably or immovably.

As it will become apparent from FIG. 1 the spray arms 6 are secured to the vat 1 of the cooling device and are spread in several, vertically spaced-apart rows over the circumference of the vat, where the circumferential spacing is preferably equal and the spray arms 6, 8 in the upper and lower corners of the vat are each arranged at an angle with the axis 5, whereas the spray arms or nozzles midway in the vat are horizontally attached to the inner wall of the vat 1. The holder for the component 2 is stationary and indicated by the numeral 7. The holder is designed such that its structure will not interfere with the spray from the nozzles and/or spray pipes. In a most simple case, air under pressure can be admitted through the nozzles or spray pipes 6, 8, said compressed air being produced by a blower in a manner permitting the pressure and flow per unit time to be controlled. Admitted also through the spray pipes or nozzles 6, 8 may be cooling water or some other medium of a preselected and conceivably regulated temperature by means of pumps controlled in the same manner as the compressed-air blower.

The numeral 9 indicates a nozzle which is arranged on the central axis 5 in the drawing such that it aims from above at the inside diameter of the component 2 through a spacer pipe 10, which directs the jets from the nozzle such that they impinge upon the surface of the hub bore 4 in preferably uniform distribution or in any other desired distribution. The nozzle 9 can be designed as a mixture nozzle especially for two substances, such as air from the pipe 11 and water from the pipe 12, where the mix of the two substances is infinitely variable by way of known valve control provisions omitted in the drawing.

Figure 2:
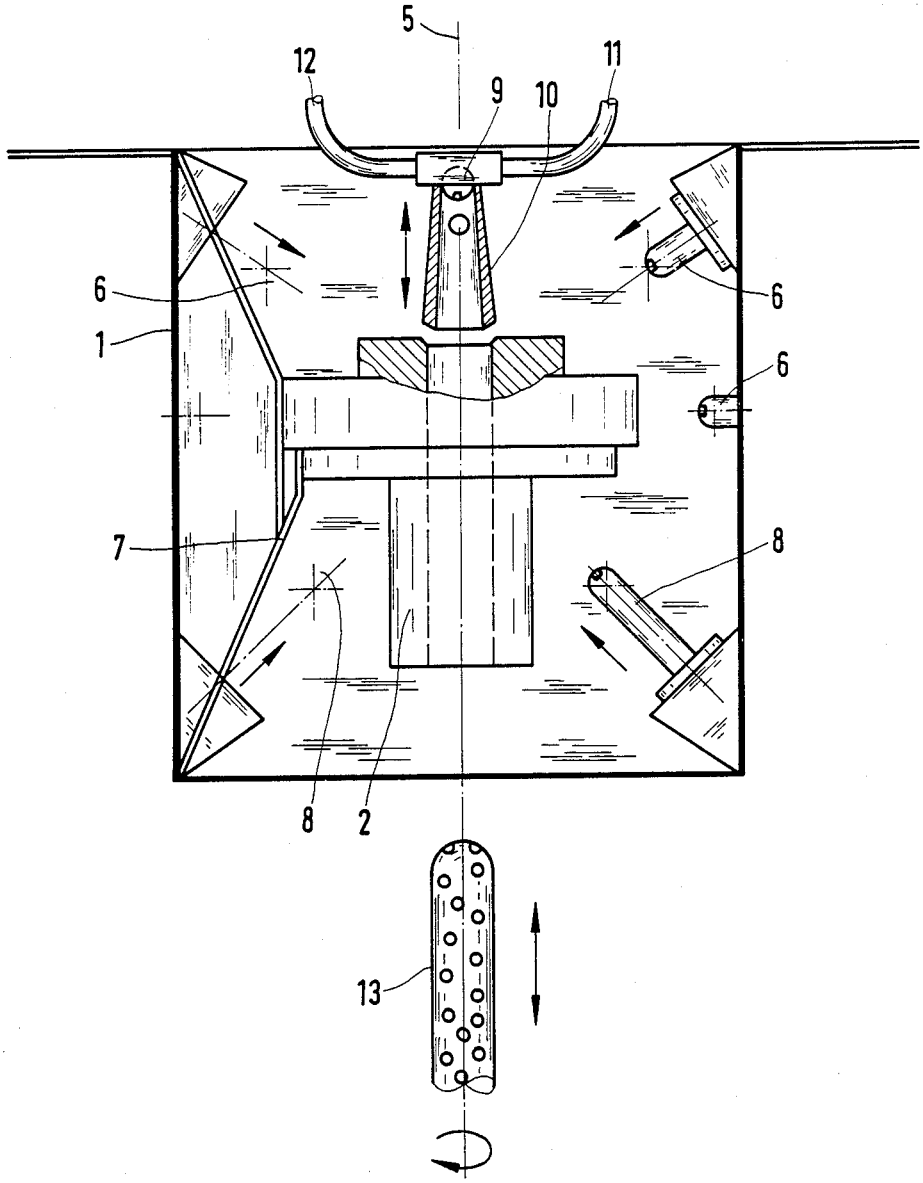
Figure 3:
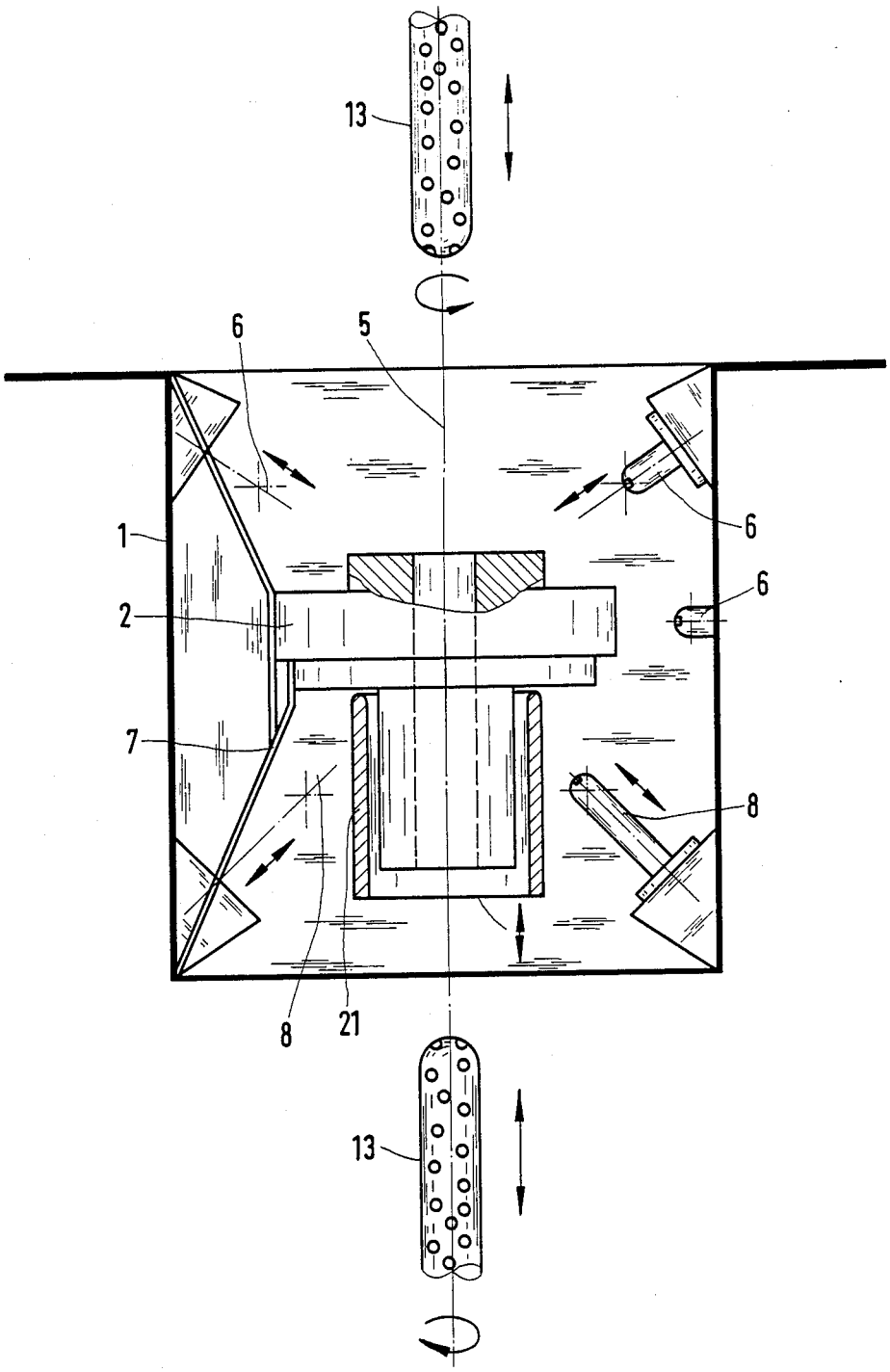

In lieu of straight water, use can advantageously be made also of an emulsion, which here has desirable properties such as solubility in water and ease of spraying in the form of droplets or mist. FIG. 2 illustrates a variant on the embodiment of FIG. 1, where from below, a spray pipe is inserted along the central axis 5 and made to rotate preferably on the reaction wheel principle. The directions of translatory and rotational motions are indicated by arrowheads. The nozzle 9 can naturally also be designed like the spray pipe 13 and be counterrotational to it in a controlled manner (see FIG. 3).

Figure 4:
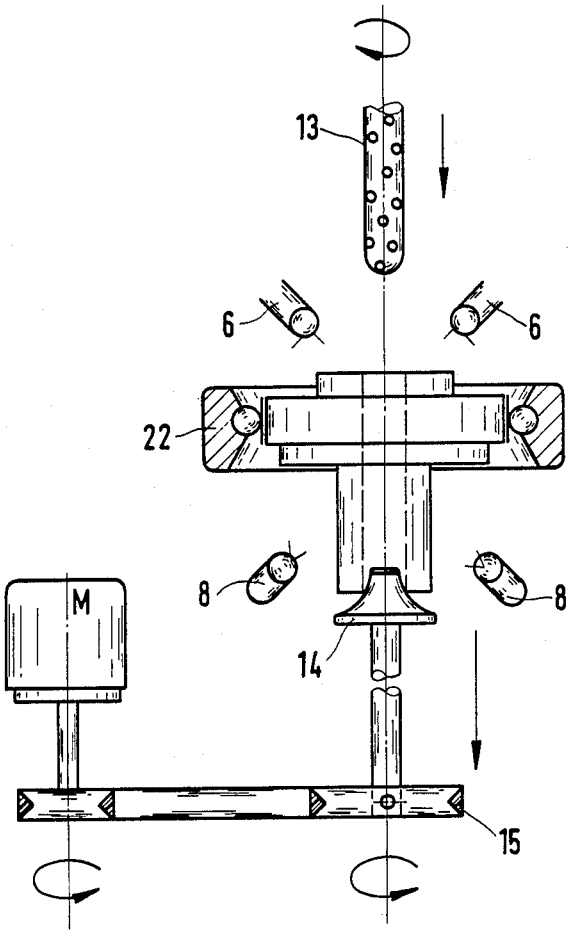
FIG. 4 illustrates the device with rotating component and at least partially arrested nozzle arrays or spray arms.
Figure 5:
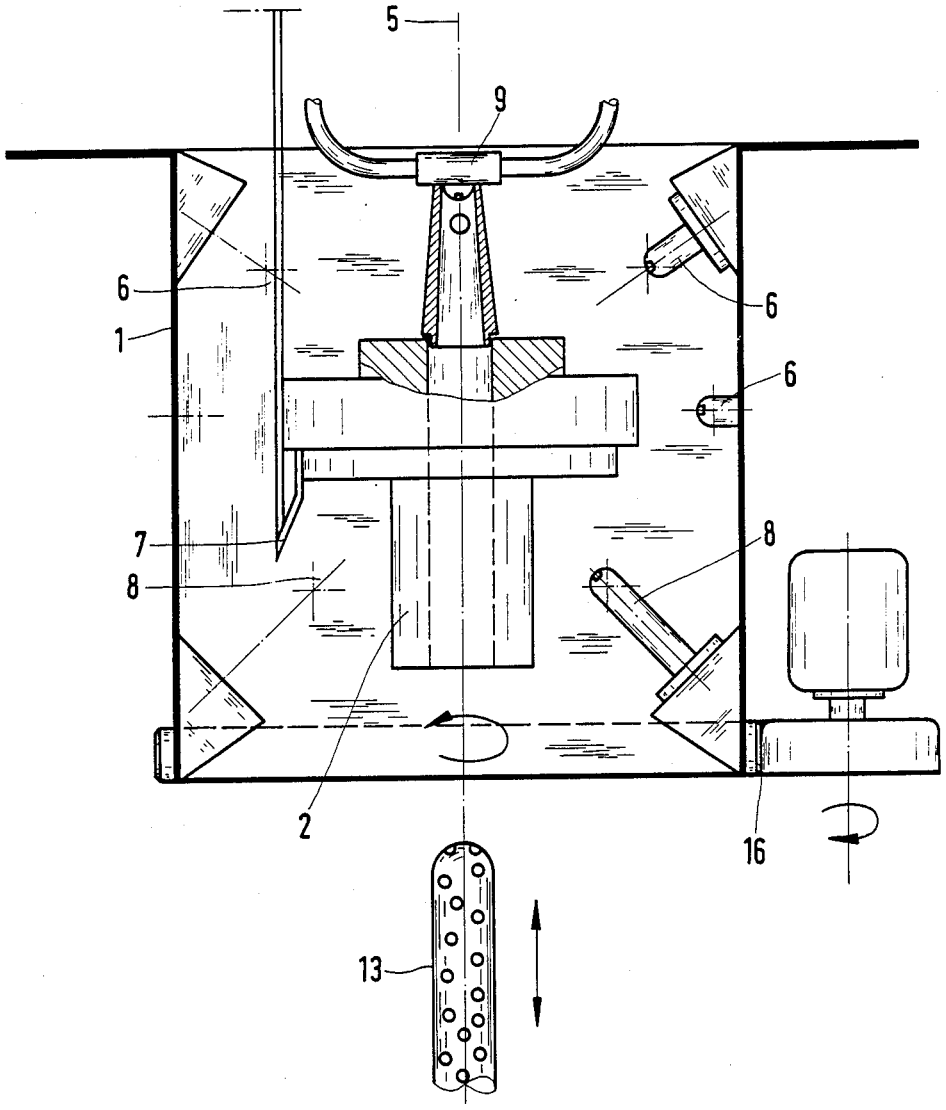
FIG. 5 illustrates the device with the component stationary or rotating counter the sense of rotation of the vat.

Illustrated in FIG. 4 is a cooling device with a rotatable holder for the component 2 using, e.g., a drive pulley with a centering cone 14 and a V-belt drive mechanism 15. Suitable also for the purpose is any other controllable drive provision for slow rotational speeds, especially a speed-controlled electric motor or a geared motor.

This applies similarly to a version in which the vat 1 of the cooling device rotates and the holder for the component is stationary. Rotation is about the central axis 5 and can be effected through friction rolls 16, gear/ring gear or similar provision.

Figure 6:
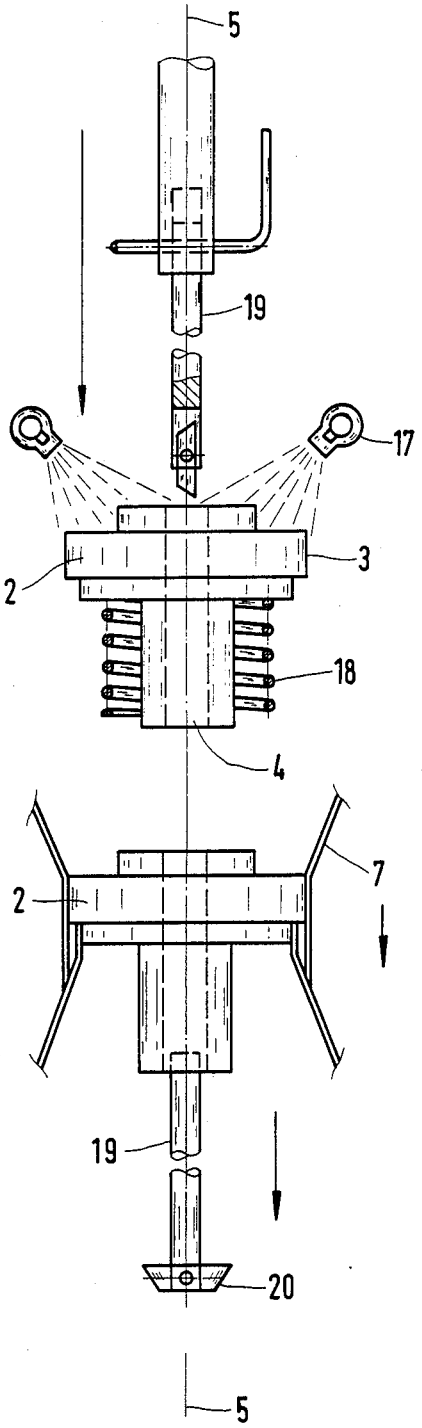
FIG. 6 illustrates a conveyer diagram showing the passage of the component from the furnace to the cooling station and further treatment stations, if present.

FIG. 6 illustrates the passage of the component from the furnace to the cooling station along the axis 5, where below the vat a further treatment tank can follow such that the axis 5 remains the centerline of the tank. Contained in the tank may be an inert gas atmosphere or a reaction gas of a fluid, as perhaps a treatment fluid to precipitate, delay or allow to decay post-treatments or reactions, or to effect cooling and drying to room temperature.

In the furnace one or several heaters may be arranged, such as IR radiator 17 and/or an inductive heating coil 18. It may also be desirable to insert a heating rod centrally into the hub 4.

For conveying, use is advantageously made of a remotely controlled manipulator 19 with a movable gripper 20, insulator 21, ball bearing race 22.

What is claimed is:

1. Apparatus for treating a rotational body having a central bore, such as a turbomachine wheel disk provided with a hub bore, comprising:

treatment vat means, rotational body mounting means for mounting a rotational body in said treatment vat means, a plurality of treatment nozzle means for spraying tempering medium against the surfaces of a rotational body being treated in the vat means, at least some of said nozzle means extending at an angle with respect to a body rotational axis and aimed at outer circumferential surface areas of a rotational body being treated, at least one of said nozzle means being mounted for spraying tempering medium against internal surfaces of a central bore of a rotational body being treated, and control means for controlling the spraying of tempering medium against a rotational body being treated such that predetermined different internal stresses are generated at different locations in the rotational body to prestress the rotational body differently at different locations to withstand predetermined mechanical and thermal stresses expected in use on turbomachinery or the like due to rotational mechanical forces and to fluid forces.

2. Apparatus according to claim 1, wherein at least one of said treatment nozzle means includes means for simultaneously spraying two different tempering media with different heat dissipation capacities.

3. Apparatus according to claim 2, wherein at least one of said treatment nozzle means includes means for simultaneously spraying air and water as tempering media.

4. Apparatus according to claim 1, wherein the at least one of said nozzle means mounted for spraying tempering medium against internal surface of a central bore of a rotational body includes means for simultaneously spraying two different tempering media with different heat dissipation capacities.

5. Apparatus according to claim 4, wherein at least one of said treatment nozzle means includes means for simultaneously spraying air and water as tempering media.

6. Apparatus according to claim 1, wherein the rotational body mounting means includes means for mounting a rotational body so as to be co-axial with a central axis of the vat means, and wherein driving means are provided for drivingly rotating the rotational body with respect to the vat means during the spraying of tempering medium against the rotational body.

7. Apparatus according to claim 2, wherein the rotational body mounting means includes means for mounting a rotational body so as to be co-axial with a central axis of the vat means, and wherein driving means are provided for drivingly rotating the rotational body with respect to the vat means during the spraying of tempering medium against the rotational body.

8. Apparatus according to claim 4, wherein the rotational body mounting means includes means for mounting a rotational body so as to be co-axial with a central axis of the vat means, and wherein driving means are provided for drivingly rotating the rotational body with respect to the vat means during the spraying of tempering medium against the rotational body.

9. Apparatus according to claim 8, wherein said treatment nozzle means includes means for spraying tempering medium at different pressures at different locations of the rotational body.

10. Apparatus according to claim 1, wherein said treatment nozzle means includes means for spraying tempering medium at different pressures at different locations of the rotational body.

11. Apparatus according to claim 1, wherein said treatment nozzle means includes means for spraying tempering medium at different temperatures at different locations of the rotational body.

12. Apparatus according to claim 10, wherein said treatment nozzle means includes means for spraying tempering medium at different temperatures at different locations of the rotation body.

13. Apparatus according to claim 1, wherein at least one of said treatment nozzle means is arranged for alternating motion about a central axis of a rotational body mounted at the mounting means.

14. Apparatus according to claim 1, wherein at least two of said treatment nozzle means are disposed for relative motion with respect to one another during the spraying of tempering medium against the rotational body.

15. Apparatus according to claim 14, wherein said one of said treatment nozzle means which is movable is additionally rotatable by means of a reaction wheel.

16. Apparatus according to claim 1, wherein said rotational body mounting means includes means for rotatably supporting a rotational body at the vat means, and wherein said plurality of said treatment nozzle means are stationarily disposed with respect to the vat means.

17. Apparatus according to claim 1, further comprising at least partial thermal insulation means interposed between the treatment nozzle means and the rotational body means.

18. Apparatus according to claim 1, further comprising a thermal treatment station, such as a furnace, a cooling or drying station, or the like, disposed adjacent the vat means.

19. Apparatus according to claim 18, further comprising conveying means for conveying for conveying a rotational body along its central axis as it is moved between a central axis of the furnace or the like and the vat means.

20. Apparatus according to claim 1, wherein said control means includes means for automatically infinitely varying control of the nozzle means.

21. Method for treating a rotational body having a central bore, such as a turbomachine wheel disk provided with a hub bore, comprising:

providing a treatment vat means, mounting a rotational body in said treatment vat means via rotational body mounting means, spraying tempering medium against the surfaces of a rotational body being treated in the vat means via a plurality of treatment nozzle means, at least some of said nozzle means extending at an angle with respect to a body rotational axis and aimed at outer circumferential surface areas of a rotational body being treated, at least one of said nozzle means being mounted for spraying tempering medium against internal surfaces of a central bore of a rotational body being treated, and controlling the spraying of tempering medium against a rotational body being treated such that predetermined different internal stresses are generated at different locations in the rotational body to prestress the rotational body differently at different locations to withstand predetermined mechanical and thermal stresses expected in use on turbomachinery or the like due to rotational mechanical forces and to fluid forces.

22. A method according to claim 21, wherein said spraying includes simultaneously spraying two different tempering media with different heat dissipation capacities from at least one of said treatment nozzle means.

23. A method according to claim 22, wherein said spraying includes simultaneously spraying air and water as tempering media from at least one of said treatment nozzle means.

24. A method according to claim 21, further comprising rotatably moving the rotational body about an axis which is co-axial with a central axis of the vat means during said spraying.

25. A method according to claim 21, wherein said spraying includes spraying tempering medium at different pressures at different locations of the rotational body.

26. A method according to claim 21, wherein said spraying includes spraying tempering medium at different temperatures at different locations of the rotational body.

27. A method according to claim 10, wherein said treatment nozzle means includes means for spraying tempering medium at different temperatures at different locations of the rotational body.

28. A method according to claim 1, wherein said spraying includes moving at least one of said treatment nozzle means about a central axis of a rotational body mounted in the mounting means.

29. A method according to claim 21, wherein said spraying includes rotating the body about a central axis of the vat means means while holding the temperature nozzle means in a stationary position with respect to the vat means.

30. A method according to claim 21, further comprising at least partially thermally insulating the rotational body during said spraying.

* * * * *